United States Patent [19]

Matalia et al.

[11] 4,373,443

[45] Feb. 15, 1983

[54] METHOD OF HIGH VISCOSITY INKING IN ROTARY NEWSPAPER PRESSES

[75] Inventors: Harshad D. Matalia, Easton, Pa.; Menashe Navi, New York, N.Y.

[73] Assignee: American Newspaper Publishers Association, Easton, Pa.

[21] Appl. No.: 322,603

[22] Filed: Nov. 18, 1981

Related U.S. Application Data

[63] Continuation of Ser. No. 122,105, Feb. 15, 1980, abandoned.

[51] Int. Cl.[3] ..... B41F 31/04; B41F 31/06; B41F 31/26

[52] U.S. Cl. ..... 101/221; 101/350; 101/363; 101/177

[58] Field of Search ..... 101/350, 363, 364, 348, 101/207, 208, 210, 148, 147, 365, 351, 352, 170, 220, 221, 222, 179, 180

[56] References Cited

U.S. PATENT DOCUMENTS

| | | | |
|---|---|---|---|
| 1,807,921 | 6/1931 | Lang et al. | 101/154 |
| 2,240,762 | 5/1941 | Dietrich | 101/350 |
| 2,256,514 | 9/1941 | Bruesaber | 101/350 |
| 2,276,662 | 3/1942 | Matuschke | 101/363 |
| 2,310,788 | 2/1943 | Hummelchen | 101/350 |
| 2,376,620 | 5/1945 | Piazze | 101/157 |
| 2,711,132 | 6/1955 | Viscardi | 101/170 |
| 2,891,471 | 6/1959 | Sengewald | 101/150 |
| 3,036,927 | 5/1962 | Jerothe | 101/350 |
| 3,180,257 | 4/1965 | Shields | 101/154 |
| 3,585,932 | 6/1971 | Granger | 101/350 |
| 3,613,578 | 10/1971 | Heurich | 101/350 |
| 3,630,146 | 12/1971 | Shields | 101/351 |
| 3,818,830 | 6/1974 | Schultz | 101/350 |
| 4,009,658 | 3/1977 | Heurich | 101/348 |
| 4,026,210 | 5/1977 | Merzagora | 101/350 |
| 4,152,986 | 5/1979 | Dadowski | 101/170 X |
| 4,158,333 | 6/1979 | Navi | 101/364 |
| 4,186,661 | 2/1980 | Vieau | 101/178 |
| 4,208,963 | 6/1980 | Dahlgren | 101/141 |
| 4,227,452 | 10/1980 | Tamai | 101/1 |
| 4,233,898 | 11/1980 | Dahlgren | 101/138 |
| 4,244,292 | 1/1981 | Williams | 101/350 |
| 4,271,760 | 6/1981 | Corse | 101/142 |

*Primary Examiner*—J. Reed Fisher

*Attorney, Agent, or Firm*—David H. Semmes; Warren E. Olsen

[57] ABSTRACT

Letterset, rotary newspaper printing press systems, particularly a method of enhancing inking of the plate cylinder. The method includes defining a plurality of ink repository cells within the surface of the inking cylinder, immersing the repository cells within an ink reservoir, scraping excess ink from the surface of the plate cylinder and rotating the inking cylinder and ink-filled cells against the plate form roller or directly against the surface of the plate cylinder. Modifications of invention include increasing the amount of ink deposited on the plate cylinder by reducing the number of ink cells per lineal inch and reducing the amount of ink deposited on the plate cylinder by increasing the amount of ink repository cells per lineal inch.

1 Claim, 7 Drawing Figures

METHOD OF HIGH VISCOSITY INKING IN ROTARY NEWSPAPER PRESSES

CROSS REFERENCE TO RELATED APPLICATIONS

A continuation of applicant's METHOD OF ENHANCING INKING IN ROTARY NEWSPAPER PRESSES Ser. No. 122,105), filed Feb. 15, 1980, now abandoned.

BACKGROUND OF THE INVENTION

1. Field of Invention

Rotary newspaper printing press inking systems, particularly an ink feed station providing precise ink flow adjustment with a minimum of mechanical parts, eliminating, for example, most rollers, all oscillators and the like. According to this invention, ink may be metered from an engraved roller by either one of the following:

(1) The flexographic system, which uses a rubber covered roller to squeeze excess ink off the engraved roller and which in ineffective with high viscosity printing inks where the ink layer thickness becomes a function of press speed.

(2) The gravure system where a doctor blade is applied to the inked plate cylinder in a positive angle manner. This system is effective only with very low viscosity type ink such as gravure or flexographic ink.

In this invention, applied to rotary newspaper press ink systems, the ink is metered from an engraved roller immersed in letterpress ink with a reverse angle doctor blade removing all of the surface ink, except that ink which is contained in the engraved roller cells.

The present system can be retrofitted in conventional letterpress printing units with minimum alterations. Its primary advantage is uniform ink flow distribution across the web, while eliminating the conventional train of plural ink rollers below the top or last drum or the necessity for an oscillation system in an ink roller. A single engraved or "ANILOX" ink roller supplies and maintains a fresh ink film of uniform thickness.

Since many ink system rollers are eliminated, there is a reduction in ink mist due to ink spitting as roller contacts, and a reduction in workroom noise level, as well as a reduction in energy required to drive the press. These benefits contribute materially to enhancing the working environment under present OHSA standards.

The method is simple and economical and is admirably suited to retro-fitting in an existing letterpress unit.

2. Description of the Prior Art

LANG: U.S. Pat. No. 1,807,921
DIETRICH: U.S. Pat. No. 2,240,762
HUMMELCHEN: U.S. Pat. No. 2,310,788
PIAZZE: U.S. Pat. No. 2,376,620
VISCARDI: U.S. Pat. No. 2,711,132
SENGEWALD: U.S. Pat. No. 2,891,471
GRANGER: U.S. Pat. No. 3,585,932
SHIELDS: U.S. Pat. No. 3,180,257
SHIELDS: U.S. Pat. No. 3,630,146
MERZAGORA: U.S. Pat. No. 4,026,210
HURICH: U.S. Pat. No. 3,613,578

These references are discussed in an accompanying Prior Art Statement.

SUMMARY OF THE INVENTION

Conventional inking systems for letter presses use eight to ten rollers, including two plate inking rollers. The present system has a single plate inking roller, instead of the conventional two.

According to the present method, an engraved inking roller is provided with a plurality of ink repository cells engraved in its cylindrical surface. As the inking roller is immersed in the ink reservoir, ink is retained in the repository cells. A reverse angle doctor blade is used to scrape off excess ink from the cylindrical surface prior to contact of the repository cells with the plate cylinder, then re-immersing of the engraved cells with the ink reservoir.

After being scraped by the doctor blade, the engraved roller contains a specified quantity of ink which is a function of repository cell configuration. The cells may be variously configured to provide more or less ink to the plate cylinder. Thus, ink is delivered uniformly across the press and transferred only to the contacting segments of the plate cylinder. There are no mechanical adjustments to be made, since the density level of the finished product is a function of both ink type and engraved repository cell configuration. Once these parameters are determined, there is no need to adjust the ink settings on the press.

DESCRIPTION OF THE PREFERRED EMBODIMENTS

Figure 1:
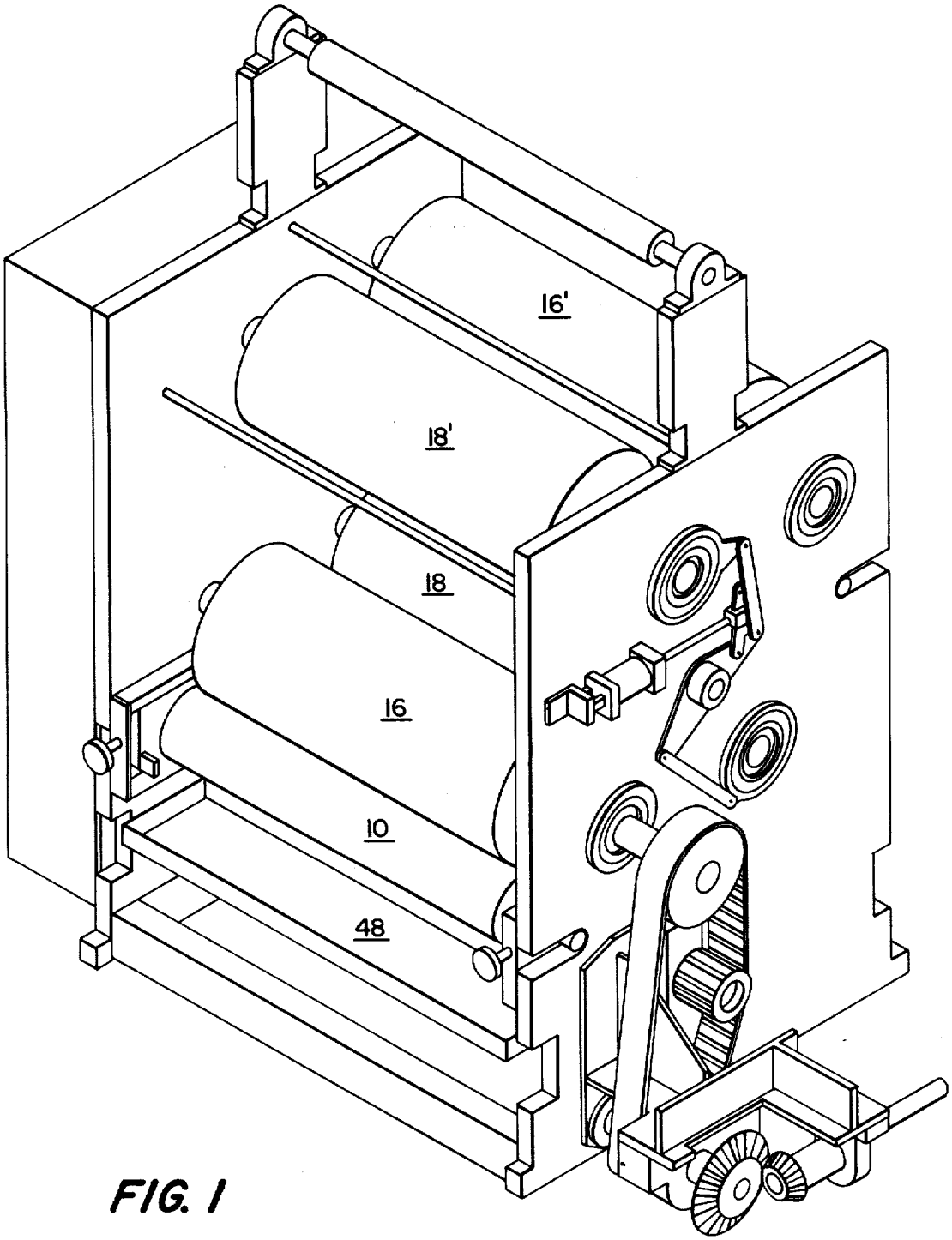
FIG. 1 is a perspective of a dual system, showing in the lower foreground, inking cylinder 10 contacting plate cylinder 16.

According to the present invention, inking of the plate cylinder may be enhanced by the employment of an engraved surface roller or inking cylinder which may be engraved with ink repository cells in the range 200–360 cells per lineal inch. The surface may then be hardchrome-plated for wear resistance and the inking cylinder, plate cylinder and impression cylinder may be driven by a drive train, such as is illustrated in FIG. 1.

Figure 2:
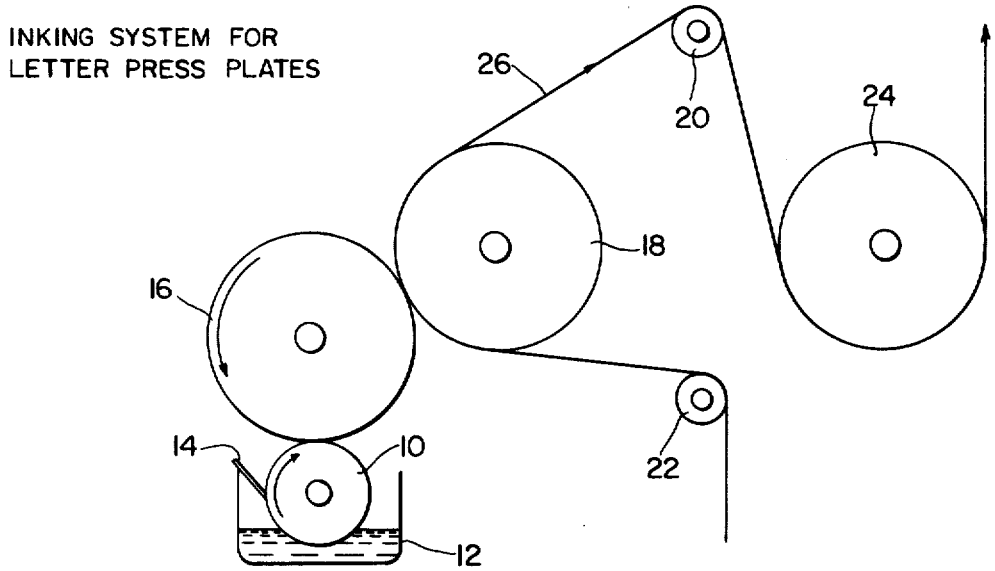
FIG. 2 is a schematic view of an inking system for a letterpress or raised image plate, according to the present invention.
Figure 5:
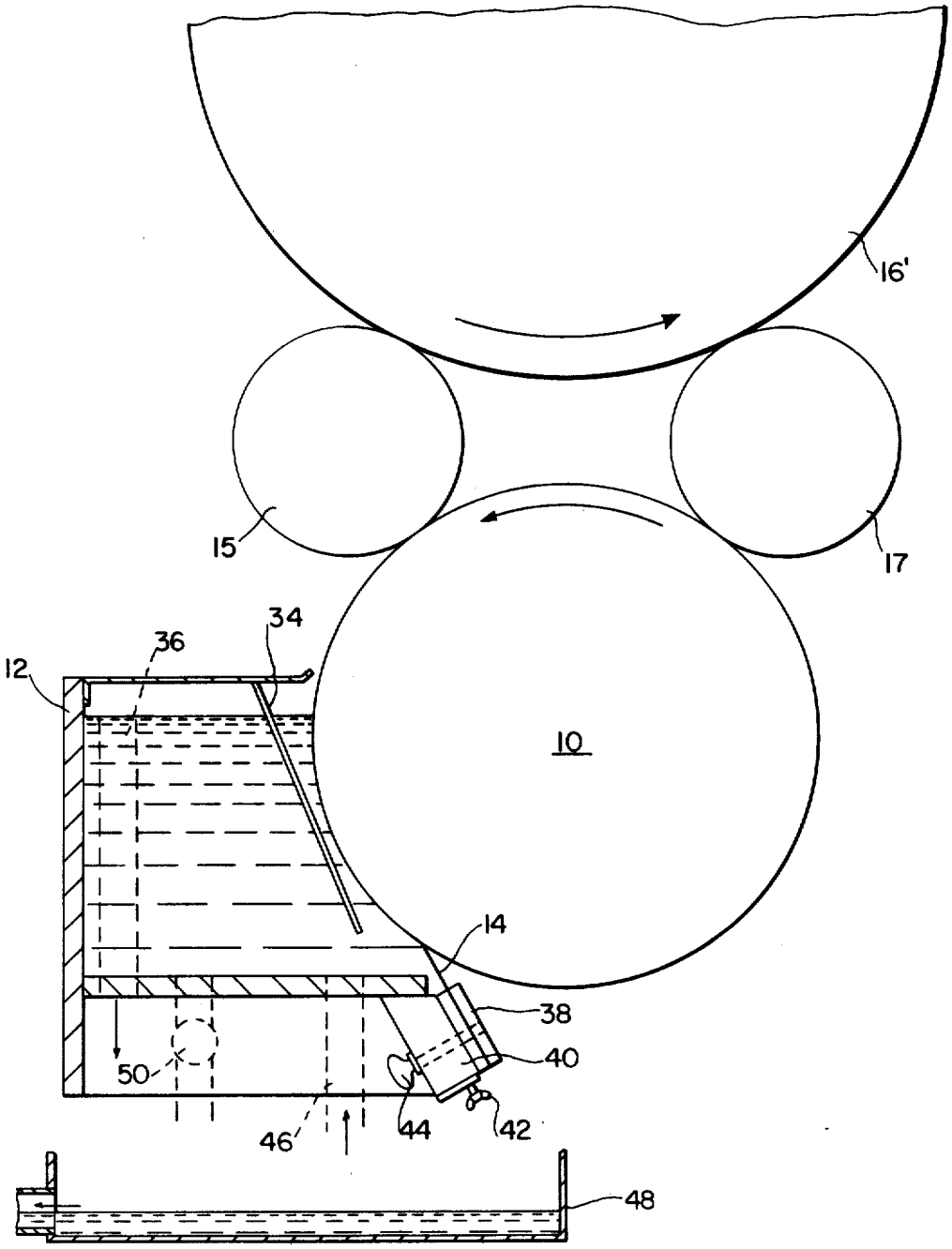
FIG. 5 is an enlarged schematic view, showing a system wherein an engraved "ANILOX" inking cylinder contacts the ink reservoir with intermediate form rollers for contact to the plate cylinder.

As illustrated in FIGS. 2 and 5, the inking cylinder 10 is immersed within ink reservoir 12, so as to fill the ink repository cells, thence doctor blade 14 wipes clean the surface of the cylinder 10, leaving the individual ink repository cells filled to the top. A fresh ink film of uniform thickness is transferred, thusly, to the plate cylinder.

According to the present invention, engraved surface cylinder 10, having a plurality of ink repository cells is rotatably mounted with respect to ink reservoir 12. As the ink filled cells are rotated towards plate cylinder 16, reverse angle doctor blade 14 scrapes all ink off of the top surface diameter of the engraved cylinder, regardless of ink viscosity. After being scraped by reverse angle doctor blade 14, engraved inking cylinder 10 contains a given quantity of ink which is a function of ink viscosity and the repository cell configuration. This given quantity of ink is thus applied to a letterpress or relief plate attached to plate cylinder 16. In turn, plate cylinder surface 16 contacts moving web 26 extending over idler rollers 20, 22, steel impression cylinder 18 and second impression cylinder 24.

Engraved cylinder 10 after contacting an inking plate cylinder 16, then recontacts the ink within ink reservoir 12, effectively cleansing engraved cylinder 10. A new layer of ink is then redeposited in the ink repository cells which are scraped by blade 14.

This is an "on demand inking system", the ink being provided uniformly across the press for transferral only to the contacting segments of the plate. There are no adjustments to be made. The ink density level on the finished web product 26 is a function of ink type, as well as engraved roller repository cell configuration. Once these parameters are determined, there is no need to adjust the ink settings on the press.

Figure 3:
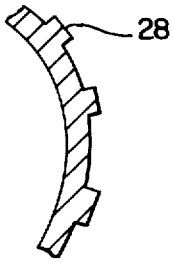
FIG. 3 is an enlarged fragmentary section of a conventional letterpress plate cylinder, approximately 0.105 inches in thickness, of the type normally used in flexography.
Figure 4:
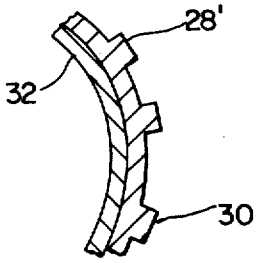
FIG. 4 is an enlarged fragmentary perspective of a reduced dimension plate cylinder, according to the present invention and wherein the cylinder embodies a resilient letterpress plate 0.030" thick, mounted upon a resilient blanket 32.
Figure 6:
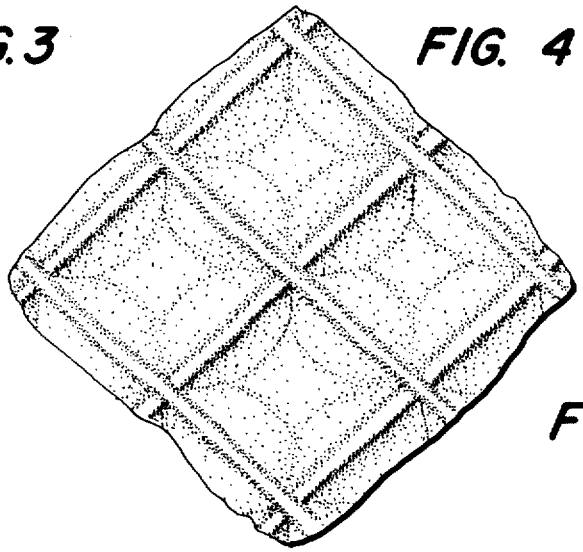
FIG. 6 is an enlarged photolithograph of the engraved inking cylinder surface, showing the truncated pyramid configuration of the ink cells, aligned such that a series of diamonds are defined with the apexes of the diamonds parallel with the axis of rotation of the inking cylinder.

In FIG. 3 there is illustrated a conventional flexographic letterpress or relief plate cylinder 28, approximately 0.105 inches in thickness. In FIG. 4 there is illustrated a modified plate cylinder having a resilient base or blanket 42, supporting a resilient letterpress or relief plate 40 approximately 0.030 inches in thickness or less. This is a high volume, low cost construction, providing a resilient foundation for overall resiliency of the plate. The operation remains similar to a conventional flexographic plate approximately 0.100–0.105 inches in thickness.

In FIG. 5 there is illustrated a retrofitted system wherein inking cylinder 10 contacts an ink reservoir 12, having an anti-turbulence baffle 34, overflow outlet 36, ink inlet conduit 46 and drain valve 50. Excess ink may be collected in drip pan 48.

Doctor blade 14 may be mounted in doctor blade holder assembly 38, including support bar 40 with parallel adjustment wing nuts 42 and thumb screw securement means 44.

Doctor blade 14 wipes the surface of the ink repository cells, leaving the cells filled to the top. Doctor blade 14 may be spring steel strip, cut to the same length as engraved inking cylinder 10. The contact edge of blade 14 may be honed and lapped to provide a straight, uniform sharp edge parallel to the surface of engraved cylinder 10 and, thereby, providing minimum contact pressure so as to leave a uniform ink film within the repository ink cells.

Figure 7:
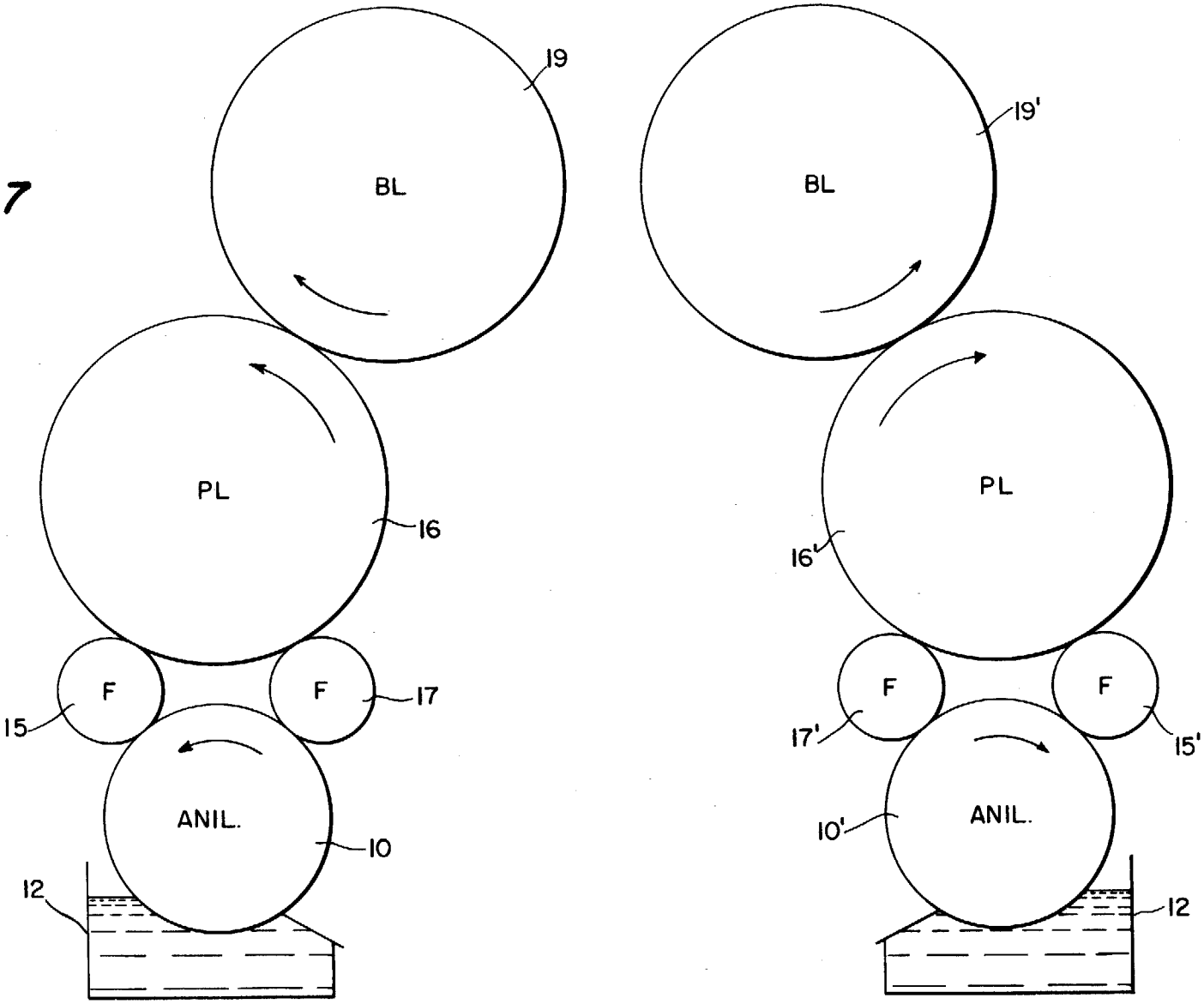
FIG. 7 is a system wherein separate "ANILOX" cylinders are used together with two pairs form rollers, for applying the ink to both sides of the web.

In FIG. 7 there is illustrated a system, where "ANILOX" inking rollers 10 and 10', respectively apply ink from reservoirs 12 and 12' to identical pairs of form rollers, 15–17 and 15'–17'. The plate cylinders 16 and 16', in turn, respectively contact both sides of the moving newspaper web against blanket cylinders 19 and 19'.

Manifestly, the reservoir itself may be varied in structure and various repository cells configurations may be employed without departing from the spirit of invention.

We claim:

1. Method of enhancing high viscosity inking in a rotary newspaper letterpress system of the type applying high viscosity ink to both sides of the web with dual inking components, each component having an ink reservoir with an inking cylinder rotably positioned therein, two form rollers rotatably contacting said inking cylinder, a plate cylinder independently contacting said form rollers and an impression cylinder contacting one side of a moving newspaper web against the plate cylinder comprising:

A. Defining a plurality of ink repository cells conformed as truncated pyramids within the surface of each inking cylinder such that there are 200–360 cells per linear inch;

B. Immersing said repository cells by rotating each said inking cylinder within its ink reservoir where the ink has a hydrocarbon base and a viscosity in the range 2,000–2,500 centipoises;

C. Reverse angle scraping of excess ink from the surface of each said inking cylinder;

D. Further rotating each inking cylinder and repository cells against the surfaces of each pair of form rollers and rotating said form rollers against each plate cylinder;

E. Printing by rotating said plate cylinders against both sides of a newspaper web moving over the surface of a rotating impression cylinder such that the speed of rotating said inking cylinder, plate cylinder and impression cylinder is at speed of printing up to 3,000 lineal feet per minute; and F. Sequentially immersing each inking cylinder within each said reservoir.

* * * * *